US008734613B1

(12) United States Patent
Frank et al.

(10) Patent No.: US 8,734,613 B1
(45) Date of Patent: May 27, 2014

(54) GLASS FIBER ENHANCED MINERAL WOOL BASED ACOUSTICAL TILE

(71) Applicant: USG Interiors, LLC, Chicago, IL (US)

(72) Inventors: William A. Frank, Lake Villa, IL (US); Terry Rosenstiel, Vernon Hills, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/935,597

(22) Filed: Jul. 5, 2013

(51) Int. Cl.

| | |
|---|---|
| ***D21H 13/40*** | (2006.01) |
| ***E04B 1/82*** | (2006.01) |
| ***D21J 1/20*** | (2006.01) |
| ***E04B 1/84*** | (2006.01) |
| *E04B 2/02* | (2006.01) |

(52) U.S. Cl.
CPC . *D21H 13/40* (2013.01); *D21J 1/20* (2013.01); *E04B 1/8409* (2013.01); *E04B 2/02* (2013.01)
USPC ..... 162/145; 162/156; 162/158; 428/292.4; 428/317.9; 181/284; 181/286

(58) Field of Classification Search
CPC ..... C04B 14/22; C04B 14/46; E04B 9/04; B29C 67/249; B29K 2309/08; B29K 2709/08; B29K 2995/0002; B32B 2262/101; D21H 13/40; D21J 1/20; B28B 29/0092
USPC ..... 162/145, 152, 156, 158, 164.1, 168.1, 162/175; 428/294.4, 317.9; 181/284, 286, 181/290
See application file for complete search history.

(56) References Cited

U.S. PATENT DOCUMENTS

| | | | | |
|---|---|---|---|---|
| 3,239,973 | A * | 3/1966 | Hahn et al. | 52/144 |
| 4,040,213 | A | 8/1977 | Capaul | |
| 4,097,209 | A * | 6/1978 | Garrick et al. | 425/82.1 |
| 4,129,637 | A * | 12/1978 | Kennedy | 264/112 |
| 4,146,564 | A * | 3/1979 | Garrick et al. | 264/516 |
| 4,226,674 | A | 10/1980 | Gross et al. | |
| 4,847,140 | A | 7/1989 | Jaskowski | |
| 5,055,341 | A | 10/1991 | Yamaji et al. | |
| 5,071,511 | A | 12/1991 | Pittman | |
| 5,148,645 | A | 9/1992 | Lehnert et al. | |
| 5,968,629 | A | 10/1999 | Masui et al. | |
| 6,284,351 | B1 | 9/2001 | Sensenig | |
| 6,443,256 | B1 * | 9/2002 | Baig | 181/286 |
| 6,616,804 | B2 | 9/2003 | Foster et al. | |
| 6,743,830 | B2 * | 6/2004 | Soane et al. | 521/83 |
| 6,877,585 | B2 * | 4/2005 | Tinianov | 181/290 |
| 6,929,091 | B2 * | 8/2005 | Bertagni et al. | 181/150 |
| 7,294,218 | B2 | 11/2007 | Haque et al. | |
| 7,547,375 | B2 | 6/2009 | Jaffee et al. | |
| 7,842,629 | B2 | 11/2010 | Jaffee | |
| 8,062,565 | B2 | 11/2011 | Mueller et al. | |
| 2002/0029929 | A1 * | 3/2002 | Tinianov | 181/290 |
| 2002/0096278 | A1 | 7/2002 | Foster et al. | |
| 2002/0128352 | A1 * | 9/2002 | Soane et al. | 523/200 |
| 2002/0139611 | A1 * | 10/2002 | Baig | 181/286 |
| 2003/0041987 | A1 | 3/2003 | Foster et al. | |
| 2003/0060113 | A1 * | 3/2003 | Christie et al. | 442/364 |
| 2004/0050619 | A1 | 3/2004 | Bargo, II | |
| 2004/0129492 | A1 * | 7/2004 | Bertagni et al. | 181/150 |
| 2005/0008845 | A1 | 1/2005 | Hatanaka et al. | |
| 2005/0266757 | A1 | 12/2005 | Roekens et al. | |
| 2007/0027283 | A1 | 2/2007 | Swift et al. | |
| 2007/0045892 | A1 * | 3/2007 | Sucech et al. | 264/171.13 |
| 2007/0060005 | A1 | 3/2007 | Yang et al. | |
| 2008/0003431 | A1 | 1/2008 | Fellinger et al. | |
| 2008/0156581 | A1 * | 7/2008 | Englert et al. | 181/290 |
| 2009/0252941 | A1 * | 10/2009 | Mueller et al. | 428/219 |
| 2009/0253323 | A1 * | 10/2009 | Mueller et al. | 442/150 |
| 2010/0101891 | A1 | 4/2010 | Kamikawa | |
| 2010/0320029 | A1 * | 12/2010 | Cao et al. | 181/286 |
| 2011/0021101 | A1 | 1/2011 | Hawkins et al. | |
| 2012/0024625 | A1 | 2/2012 | Cao et al. | |
| 2012/0161058 | A1 * | 6/2012 | Albarran | 252/62 |
| 2013/0023174 | A1 | 1/2013 | Quinn | |
| 2014/0014437 | A1 * | 1/2014 | Wilson | 181/290 |

FOREIGN PATENT DOCUMENTS

| | | | |
|---|---|---|---|
| GB | 2096943 | A * | 10/1982 |

* cited by examiner

*Primary Examiner* — Jose Fortuna
(74) *Attorney, Agent, or Firm* — Pearne & Gordon LLP

(57) ABSTRACT

A wet laid basemat for an acoustical ceiling tile comprising on a dry weight basis, 50% or more mineral wool fiber, including shot, less than 9% binder, and between 5 and 20% chopped strand glass fiber, and, optionally, minor amounts of other constituents, whereby the chopped strand glass fibers serve to promote and/or maintain voids in the mat such that the dry basemat has a density of between about 7½ to about 10½ lbs. per cubic foot and an NRC substantially greater than 0.55.

4 Claims, 4 Drawing Sheets

GLASS FIBER ENHANCED MINERAL WOOL BASED ACOUSTICAL TILE

BACKGROUND OF THE INVENTION

The invention relates to acoustical tiles particularly suited for use in suspended ceilings.

PRIOR ART

Mineral fiber based ceiling tiles have long been available. Such tiles or panels are conventionally made by water felting dilute aqueous dispersions of mineral wool. In this process, an aqueous slurry of mineral wool, binder and minor quantities of other ingredients, as desired or necessary, is flowed onto a moving foraminous support wire, such as that of a Fourdrinier or Oliver mat forming machine, for dewatering. The slurry may be first dewatered by gravity, and then dewatered by vacuum suction to form a basemat; the wet basemat is then pressed to the desired thickness between rolls or an overhead travelling wire and the support wire to remove additional water. The pressed basemat is then dried in heated drying ovens, and the dried material is cut to the desired dimensions and optionally sanded and/or top coated, or covered with an adhesively attached fiberglass scrim and ultimately painted to produce finished acoustical ceiling tiles or panels.

While water felted mineral wool based acoustical ceiling tiles are relatively economical to produce because of low raw material costs, they exhibit relatively low NRC (noise reduction coefficient) values of about 0.55. It has long been desirable to produce mineral fiber-based acoustical ceiling tiles with improved NRC values.

SUMMARY OF THE INVENTION

The invention provides a mineral wool based water felted acoustical ceiling tile construction that achieves improved NRC values and that can be produced in existing facilities and with conventional processing.

The invention resides in the discovery that ordinary wet used chop strand, WUCS, fiberglass, preferably of certain characteristics, can be substituted in small fractional quantities for mineral fiber in a typical product formulation. The result of the substitution is a surprising increase in loft in the basemat. This loft represents a significant decrease in density and a corresponding increase in porosity and, consequently, sound absorption.

The invention enables the production of relatively low density, relatively thick acoustical panels capable of achieving NRC values substantially greater than 0.55 and up to 0.95 or higher, putting the performance of these tiles at the high end of the spectrum of acoustical tiles.

The body of the inventive panel is characterized by the presence of voids, which are large compared to average interstitial spaces between the composite fibers, distributed randomly throughout the panel body. The voids, by some mechanism not fully understood, are created by the presence of the glass fibers. The population of the voids appears to be proportional to the quantity of glass fibers in the basemat formulation. Fiber length and fiber diameter appear to be additional factors in the successful creation of the voids.

DESCRIPTION OF THE PREFERRED EMBODIMENT

An acoustical tile or panel basemat according to the invention is produced by thoroughly mixing its constituents in a dilute water slurry. The slurry, in a generally conventional process, is distributed over a travelling screen or support wire to form a basemat layer. The layer is drained of water through the screen and by application of a suction vacuum. The mat is then lightly pressed between an overlying roll or travelling screen and the transport screen. Thereafter, the pressed basemat is dried in an oven and cut to a finished rectangular size. The face of the basemat may be finished with conventional techniques such as grinding, laminating and/or painting.

The invention departs from traditional mineral fiber based basemat formulations by substituting chopped strand fiberglass for a fraction of a standard amount of mineral wool fiber. The chopped strand fiberglass can be, for example, of the commercially available wet use chopped strand (WUCS) material.

Figure 1:
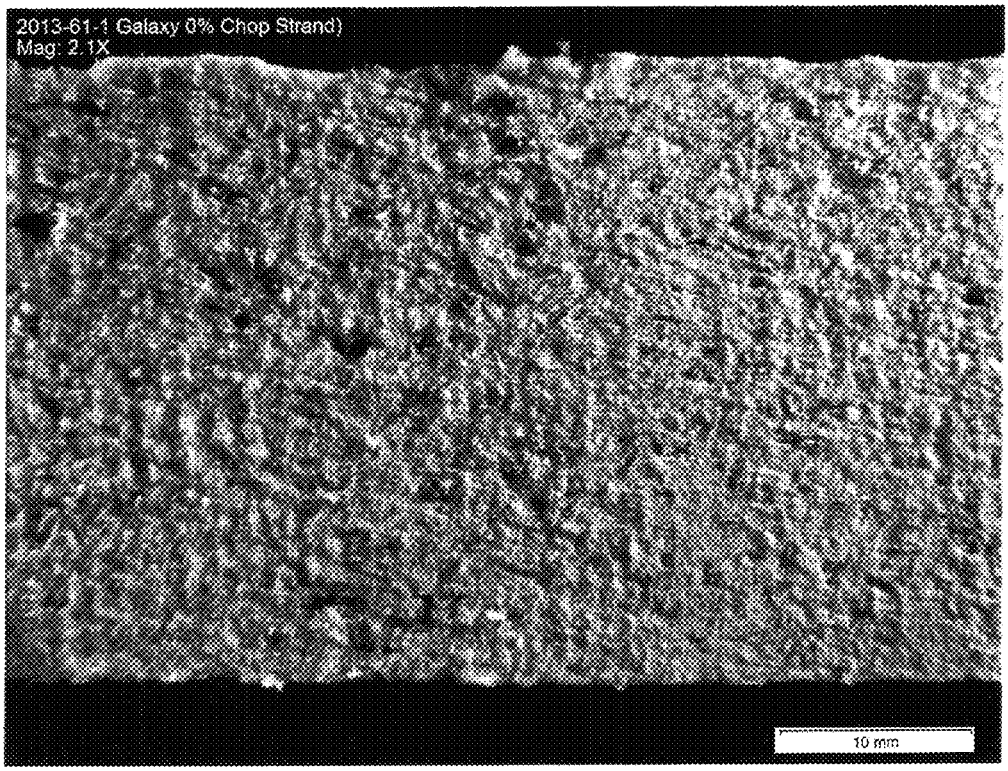
FIG. 1 (PRIOR ART)
FIG. 1 is a photomicrograph of a cross-section of an acoustical panel of a standard formulation.

FIG. 1 shows a cross-section of a part of an acoustical ceiling tile made with a generally conventional mineral fiber based formulation. The table below reflects the constituents of this conventional formula.

TABLE 1

PRIOR ART GENERAL BASEMAT FORMULATION

| | | Function |
|---|---|---|
| Density | 14 to 16.5 lbs. per cubic foot | |
| Mat Thickness | 0.730 inch to 0.780 inch | |
| Slag Wool Fiber | >75% | Strengthening/Body fiber |
| Acrylate Polymer | <5% | binder |
| Starch | <2% | binder |
| Vinyl Acetate Polymer | <2% | binder |
| Or Ethylene Acetate Polymer | <2% | binder |
| Zinc Pyrithione | <2% | antimicrobial agent |
| Crystalline Silica | <5% | inherent in coating |

Figure 2:
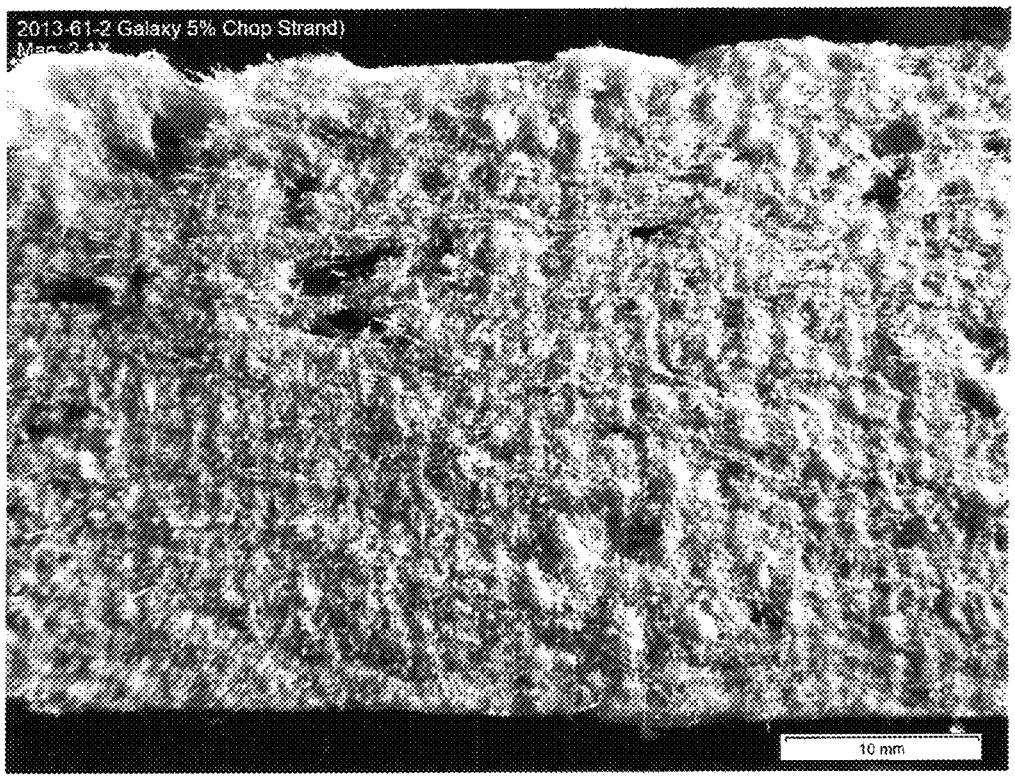
FIG. 2 is a photomicrograph of a cross-section of an acoustical tile having a modified formulation including 5% chop strand fiberglass fibers.
Figure 3:
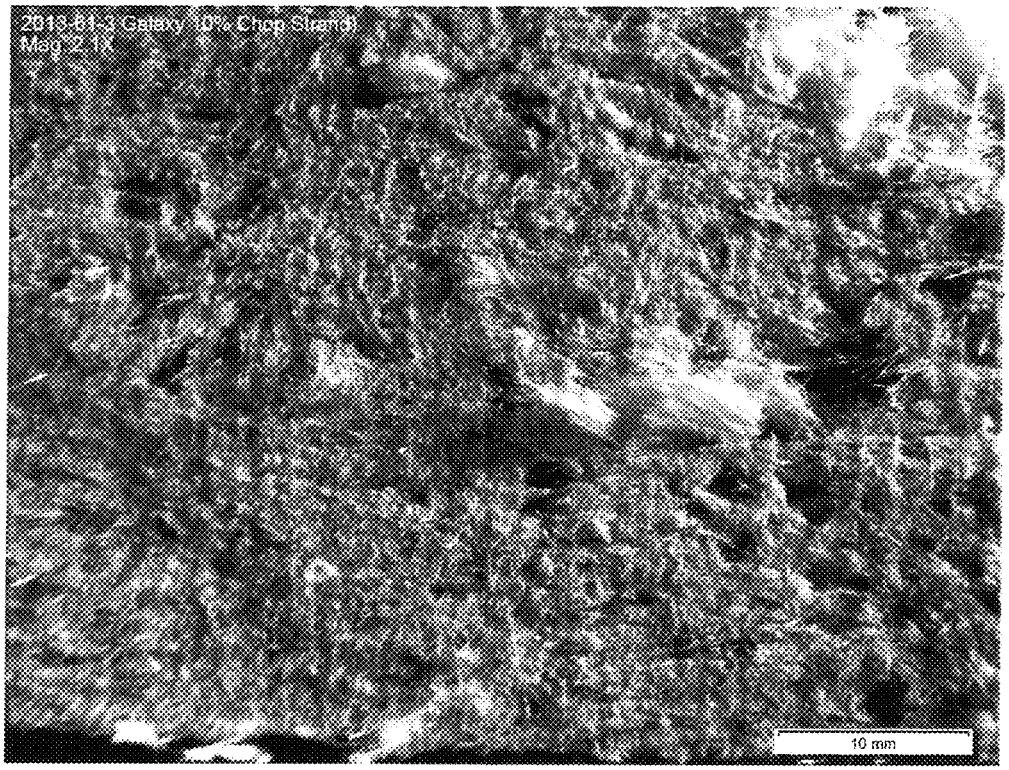
FIG. 3 is a photomicrograph of a cross-section of an acoustical tile having a modified formulation including 10% chop strand fiberglass fibers.
Figure 4:
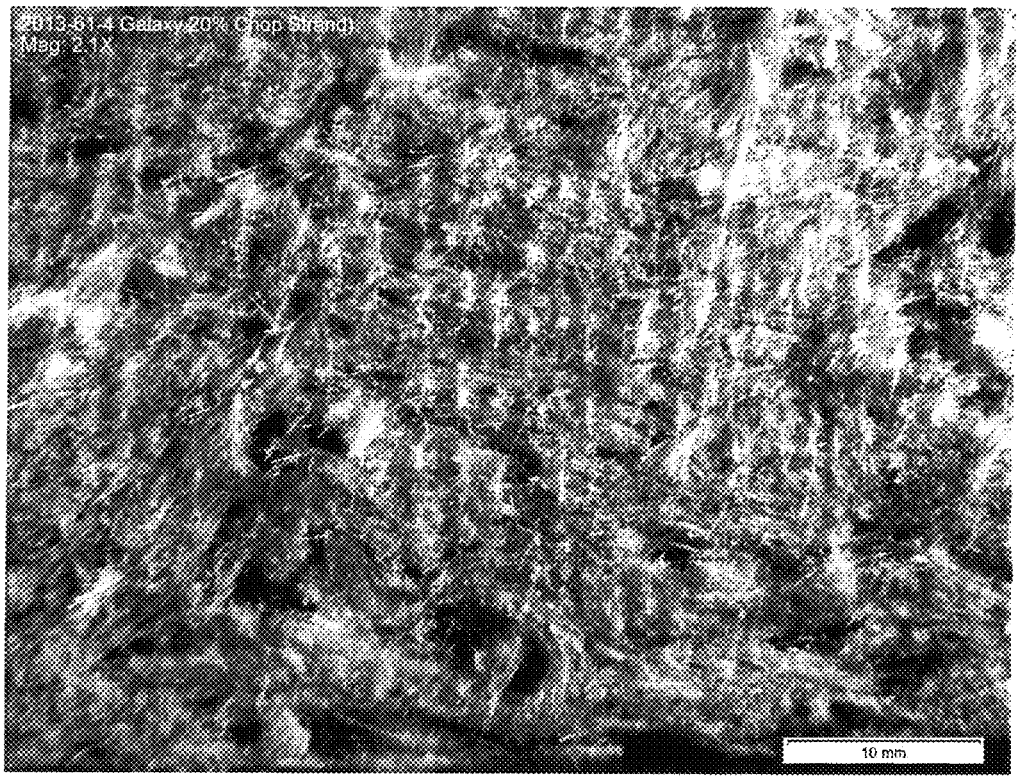
FIG. 4 is photomicrograph of a cross-section of an acoustical tile having a modified formulation including 20% chop strand fiberglass fibers.

FIGS. 2-4 show portions of cross sections of acoustical tile basemat with modified formulations. FIG. 2 is illustrative of a formulation containing 5% by weight of chop strand glass fiber, FIG. 3 shows a basemat with a 10% chop strand glass fiber composition, and FIG. 4 shows a cross-section of a basemat with a 20% chop strand glass fiber composition. In the compositions shown in FIGS. 2-4, the chop strand glass fibers are nominally ¼ inch in length and 16.5 microns in diameter.

Below is a formulation for a mineral fiber based basemat for an acoustical tile embodying the present invention.

TABLE 2

| EXEMPLARY BASEMAT FORMULATION OF INVENTION | | |
|---|---|---|
| | | Function |
| Density | 7.5 to 10.5 lbs. per cubic foot | |
| Mat Thickness | 1 inch to 1.5 inch | |
| Slag Wool Fiber | >50% | Strengthening/Body fiber |
| Chopped Strand | <25% substitution for Slag Wool | Strengthening/Body/Loft fiber |
| Acrylate Polymer | <5% | binder |
| Starch | <2% | binder |
| Vinyl Acetate Polymer | <2% | binder |
| Or Ethylene Acetate Polymer | <2% | binder |
| Zinc Pyrithione | <2% | antimicrobial agent |
| Crystalline Silica | <5% | inherent in coating |

The percentages shown in Tables 1 and 2 are weight percent.

A comparison of FIG. 1 with the remaining FIGS. 2-4 shows the presence of voids in the body of the basemat with the number of voids increasing with the chopped strand glass fiber percent content. The diameter of the fiberglass fibers is substantially greater than the diameter of the mineral fibers. The bulk density, in lbs/cubic foot of a basemat decreases proportionately with the number of voids in a specific volume. As bulk density decreases, as would be expected, the porosity of the basemat increases and its sound absorbing capacity, i.e. NRC rating, increases.

The reason that chopped strand fibers produce, or are at least associated with the occurrence of voids throughout the body of a mineral fiber based basemat is not completely understood. The individual glass fibers appear at least in some instances to hold surrounding mineral fibers out of the space of a void like the bows of an umbrella to draw an analogy. Regardless of how the chopped strand glass fibers create and/or maintain the voids, the chopped strand glass fibers, in proportion to their mass, decrease bulk density and increase NRC.

During formation of a glass fiber chopped strand containing basemat, increased loft of the wet basemat is experienced before and after it is lightly pressed by a top screen belt or roller before it is carried to a drying oven. The chopped strand fiber preferably can be between nominally ¼ and ½ inch in length and preferably have a diameter between about 13.5 microns to 16.5 microns. The finished panels made in accordance with the invention can have a density of between 7½ to 10½ lbs. per cubic foot and a mat thickness of, for example, 1 inch to 1½ inches.

A basemat typically will have its face or room side covered by a non-woven fiberglass scrim, known in the art, that is adhesively attached and when painted or coated remains air permeable.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A wet laid basemat for an acoustical ceiling tile comprising on a dry weight basis, 50% or more mineral wool fiber, including shot, less than 9% binder, and between 5 and 20% chopped strand glass fiber, and, optionally, minor amounts of other constituents, whereby the chopped strand glass fibers serve to promote and/or maintain voids in the basemat such that the basemat has a density of between about 7½ to about 10½ lbs. per cubic foot and an NRC (Noise Reduction Coefficient) substantially greater than 0.55 when dried.

2. A wet laid basemat as set forth in claim 1, wherein the chop strand fibers are nominally between ¼ inch and ½ inch in length.

3. A wet laid basemat as set forth in claim 2, wherein said chop strand fibers have nominal diameters of between 13.5 microns and 16.5 microns.

4. A web laid basemat as set forth in claim 1, having an NRC of about 0.95.

* * * * *